US006240669B1

(12) United States Patent
Spaniel et al.

(10) Patent No.: US 6,240,669 B1
(45) Date of Patent: Jun. 5, 2001

(54) MAGAZINE SAFETY

(76) Inventors: Frank A Spaniel, 117 Riverbirch Rd., Lexington, SC (US) 29072; Zdenek Prisovsky, 257 Morgan Av, Kitchener, Ontario N2A 2M7 (CA)

( * ) Notice: Subject to any disclaimer, the term of this patent is extended or adjusted under 35 U.S.C. 154(b) by 0 days.

(21) Appl. No.: 09/299,776

(22) Filed: Apr. 26, 1999

(51) Int. Cl.[7] ..... F41A 17/38
(52) U.S. Cl. ..... 42/70.02
(58) Field of Search ..... 42/70.02

(56) References Cited

U.S. PATENT DOCUMENTS

| | | |
|---|---|---|
| 1,024,932 | 4/1912 | Haeghen . |
| 1,183,115 | 5/1916 | Reising . |
| 1,234,961 | 7/1917 | Tansley . |
| 1,416,671 | 5/1922 | Artamendi . |
| 1,418,021 | 5/1922 | Reifgraber . |
| 1,638,068 | 8/1927 | Tansley . |
| 1,719,384 | 7/1929 | Tansley . |
| 1,866,202 | 7/1932 | Floyd . |
| 2,296,998 | 9/1942 | Koehler . |
| 2,372,519 | 3/1945 | Roper . |
| 2,459,838 | 1/1949 | Quinn et al. . |
| 2,563,720 | 8/1951 | Guisasola . |
| 4,016,669 | 4/1977 | Gminder . |
| 4,031,648 | 6/1977 | Thomas . |
| 4,291,481 | 9/1981 | Hillberg . |
| 4,384,420 | 5/1983 | Von Muller . |
| 4,420,899 | 12/1983 | Bourlet et al. . |
| 4,428,138 | 1/1984 | Seecamp . |
| 4,528,765 | 7/1985 | Johnson . |
| 4,532,729 | 8/1985 | Von Muller . |
| 4,798,018 | 1/1989 | Johansson . |
| 5,225,612 | 7/1993 | Bernkrant . |
| 5,388,362 | 2/1995 | Melcher . |
| 5,438,784 | 8/1995 | Lenkarski et al. . |

FOREIGN PATENT DOCUMENTS

| | | | |
|---|---|---|---|
| 680451 | * | 9/1939 | (DE) . |
| 291747 | * | 11/1928 | (GB) . |
| 37732 | * | 10/1914 | (SE) . |

* cited by examiner

*Primary Examiner*—Charles T. Jordan
*Assistant Examiner*—K. Kevin Mun
(74) *Attorney, Agent, or Firm*—Michael A Mann; Nexsen Pruet Jacobs & Pollard LLC

(57) ABSTRACT

A magazine safety for a firearm comprises a sleeve that is slidably received within a recessed pocket formed the magazine well and urged downward into the pocket by a spring. The sleeve has an upper blocking projection that engages a notch in the trigger bar of the firearm to prevent lateral movement of the trigger bar and a lower engaging projection that extends into the magazine well and engages the magazine once it is fully inserted, thereby lifting the sleeve and its blocking projection free of the notch of the trigger bar. When not lifted by the magazine against the urging of the spring, the blocking projection prevents movement of the trigger bar. Since the trigger bar is incapable of movement, the firearm cannot be fired until a magazine is inserted.

8 Claims, 4 Drawing Sheets

MAGAZINE SAFETY

BACKGROUND OF THE INVENTION

1. Field of the Invention

The present invention relates to safety mechanisms for firearms and particularly to a magazine safety.

2. Discussion of Background

Although safety mechanisms play an important role in preventing the accidental discharge of a firearm, many accidental shootings still occur each year. Carelessness and negligence factor into many accidental shootings; however, many times an undetected bullet remaining in the chamber of the firearm is unintentionally discharged. Persons familiar with firearm safety realize that a firearm may still be potentially deadly, even though the magazine is removed.

In semi-automatic firearms, the bullets are fed into the chamber automatically upon firing. Although the trigger may be actuated in rapid succession, the automatically fed bullets can become a safety hazard. Unless the entire magazine load has been fired, a bullet will remain in the chamber of the firearm.

In order to reduce the safety risks posed by a bullet remaining in the chamber of the firearm, numerous magazine safeties have been devised. A magazine safety functions to prevent movement of the trigger if the magazine is removed from the firearm; however, the trigger is free to move if the magazine is within the firearm, unless another safety prevents movement of the trigger. Unfortunately, the magazine safeties that have currently been devised are overly complex and thereby likely to fail.

Therefore, there is a need for a magazine safety having a simple design that can be manufactured in a cost-effective manner.

SUMMARY OF THE INVENTION

According to its major aspects and broadly stated, the present invention is a magazine safety for a firearm. The magazine safety comprises a sleeve that is slidably received within a recessed pocket, which is formed in the magazine well. The sleeve has an upper blocking projection that is capable of engaging a notch in the trigger bar of the firearm and a lower engaging projection that extends into the magazine well and engages the inserted magazine, thereby lifting the sleeve and removing its upper blocking projection from the notch in the trigger arm. If the magazine well is empty or a magazine is partially inserted, the sleeve is urged downward into the pocket and the upper projection is urged into engagement with the notch of the trigger arm by a spring.

The magazine safety is moved between a safe position and a fire position by the insertion of a magazine. When the magazine well is empty or a magazine that is partially inserted, the upper blocking projection engages the notch in the trigger bar, thereby preventing movement. Since the trigger bar is incapable of movement, the firearm cannot be fired. As a magazine is inserted, the magazine safety is moved into the fire position, the sleeve is lifted so that the upper blocking projection does not prevent movement of the trigger bar; consequently, the firearm is capable of firing.

A major feature of the present invention is the use of the upper blocking projection to directly prevent movement of the trigger bar. Instead of blocking the sear, as in other magazine safeties, preventing movement of the trigger bar directly results in a simpler design. Moreover, blocking the trigger bar directly allows the trigger to be stopped earlier in the motion set in place by moving the trigger than blocking the sear.

The simplicity of the design is a major advantage of the present invention. The simplicity is created by the upper blocking mechanism that engages the notch in the trigger bar directly.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
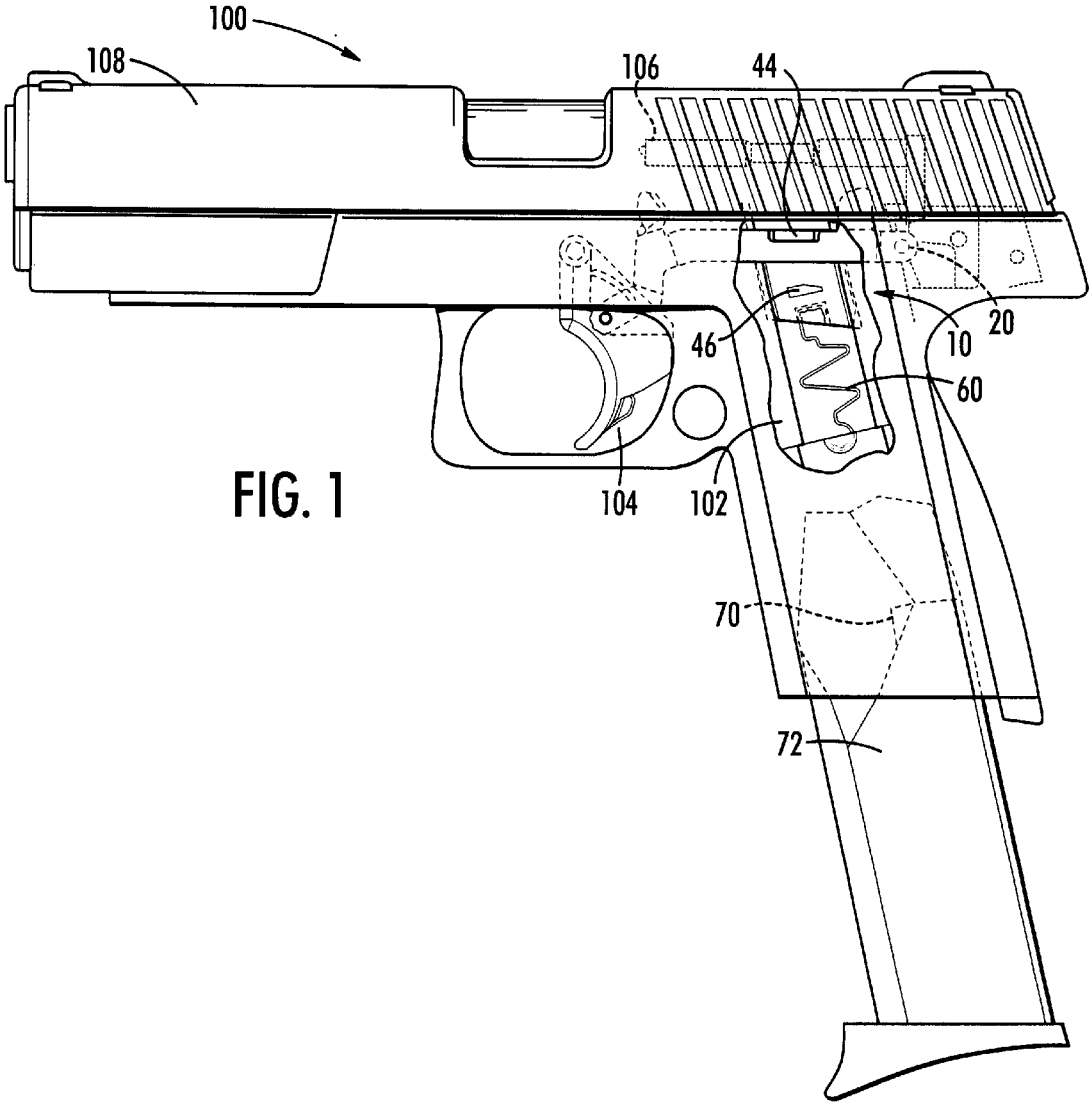
FIG. 1 is a left side view of a firearm having the magazine safety, with a magazine partially inserted, according to a preferred embodiment of the present invention.

Referring now to the figures, the present invention is a magazine safety that prevents movement of the trigger bar if the magazine is removed or not fully seated within the magazine well. The term magazine well is used to mean the walls of the cavity in the handle of the firearm that receives the magazine. A firearm has a trigger that actuates a trigger bar, which in turn actuates a firing mechanism which discharges a bullet through the barrel of the firearm. The magazine safety prevents movement of the trigger bar unless a magazine is fully seated within the magazine well. In other words, the firearm is incapable of firing unless a magazine is fully seated within the magazine well.

The magazine safety, generally referred to by reference number 10, comprises a sleeve 40 that is slidably received within a recessed pocket 30, which is positioned within the magazine well 102. Sleeve 40 has an upper blocking projection 44 that is capable of engaging a notch 22 in trigger bar 20 and a lower engaging projection 46 that extends into the magazine well 102 where it will be displaced by the magazine upon insertion. The insertion of a magazine 72 thus lifts sleeve 40; with the absence of a magazine or a partially inserted magazine, sleeve 40 remains urged downward by a spring 60.

Trigger bar 20 is actuated by trigger 104, which in turn actuates firing mechanism 106. Trigger bar 20 is operationally connected to trigger 104 and firing mechanism 106 as is common knowledge to those skilled in the art; however, trigger bar 20 has a notch 22 of sufficient dimension to receive a blocking projection 44. If blocking mechanism 44 engages notch 22, trigger bar 20 is prevented from movement and magazine safety 10 is in safe mode. In safe mode, firearm 100 is incapable of firing since trigger bar 20 cannot move to actuate firing mechanism 106. If blocking mechanism 44 does not engage notch 22, trigger bar 20 can move freely if actuated by trigger 104 and is in fire mode. In fire mode, firearm 100 is capable of discharging a bullet through barrel 108.

A pocket 30 is formed along a side wall in magazine well 102. Pocket 30 has a pair of vertical members 32 that are capable of slidably receiving sleeve 40. The downward movement of sleeve 40 within pocket 30 is limited by the bottom of pocket 30.

Figure 2:
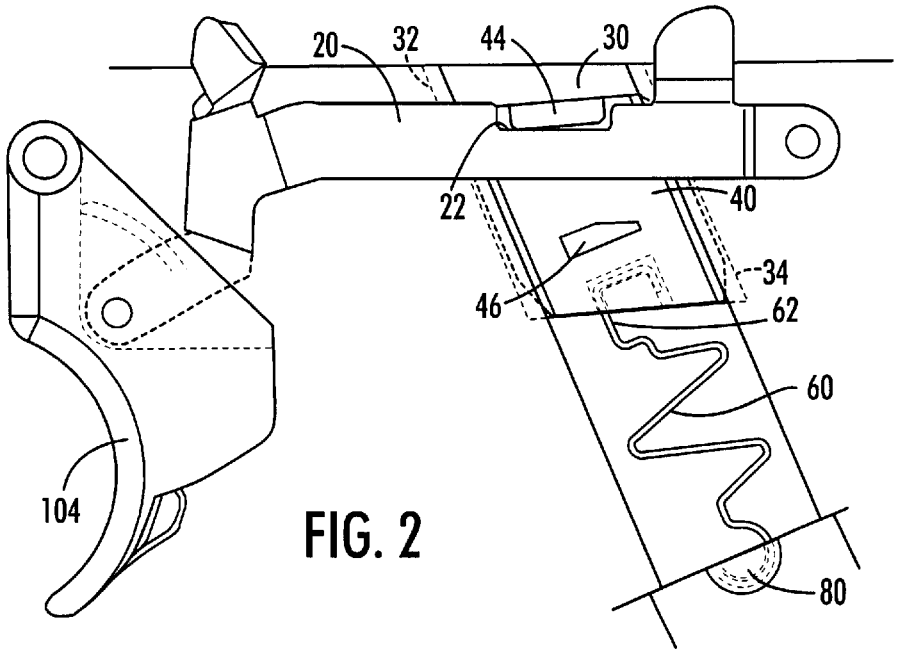
FIG. 2 is a left side detailed view of the magazine safety, with a magazine partially inserted, according to a preferred embodiment of the present invention.
Figure 3A:
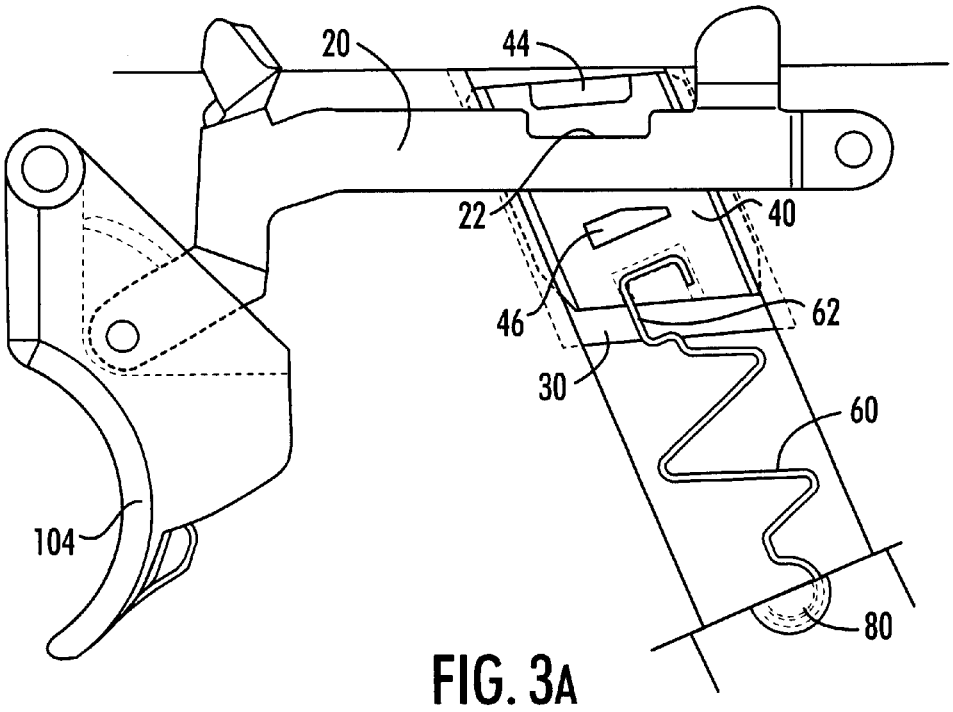
FIG. 3A is a left side detailed view of the magazine safety, with a magazine fully inserted, according to a preferred embodiment of the present invention.
Figure 3B:
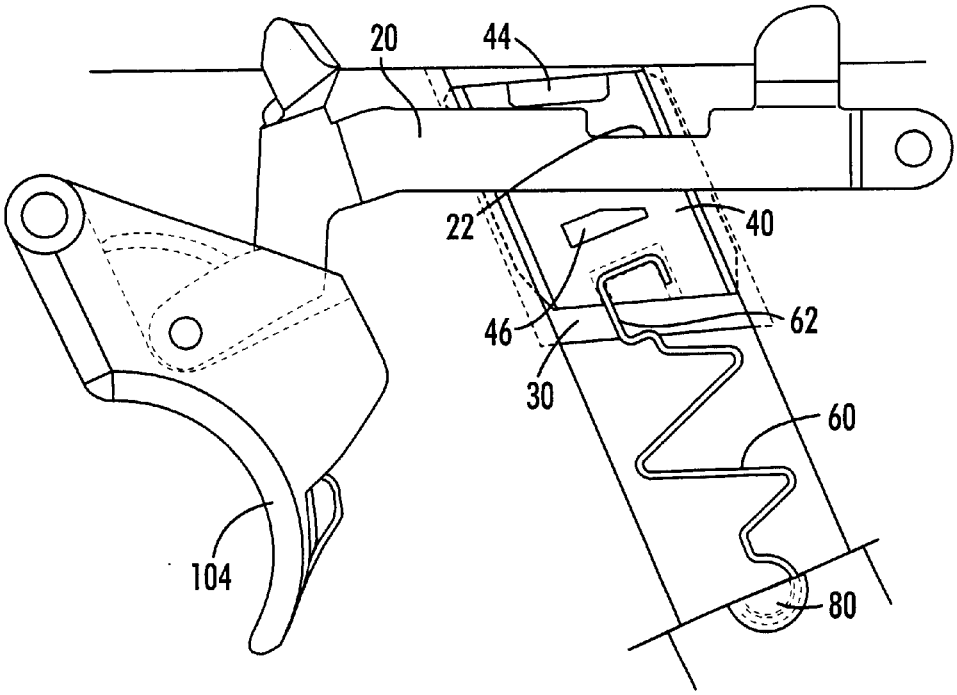
FIG. 3B is a left side detailed view of the magazine safety, with a magazine fully inserted and the trigger pulled, according to a preferred embodiment of the present invention.
Figure 5B:
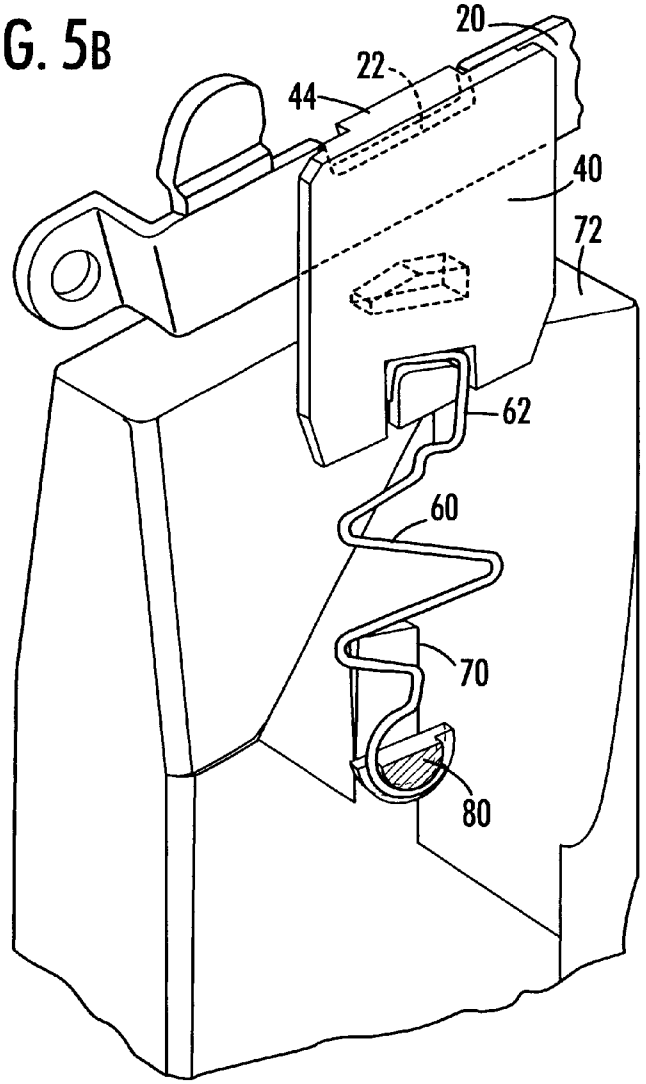
FIG. 5B is a right side perspective view of the magazine safety, with a magazine partially inserted, according to a preferred embodiment of the present invention.
Figure 5A:
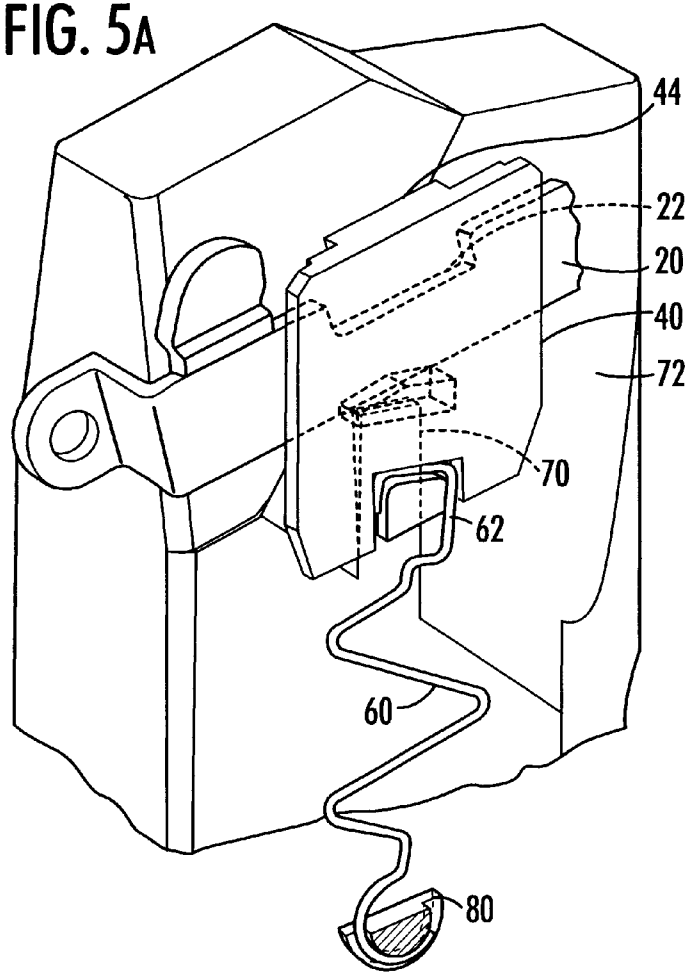
FIG. 5A is a right side perspective view of the magazine safety, with a magazine fully inserted, according to a preferred embodiment of the present invention.

Sleeve 40 slidably engages pocket 30 to operate between a safe mode as illustrated in FIG. 2 and a fire mode as illustrated in FIG. 3A. Sleeve 40 moves between safe mode and fire mode through operation of engaging projection 46. Engaging projection 46 is positioned to engage a flange 70 on magazine 72 when magazine 72 is inserted into magazine well 102, thereby lifting sleeve 40. If a magazine 72 is removed or not fully seated, sleeve 40 will not be moved upward enough for blocking projection 44 to clear notch 22 of trigger bar 20 but will continue to be urged downward by spring 60.

Sleeve 40 has an upper blocking projection 44 and a lower engaging projection 46 that extend into magazine well 102. Blocking projection 44 is positioned to engage notch 22 of trigger bar 20 in safe mode and allow free movement of trigger bar 20 in fire mode. Engaging projection 46 lifts sleeve 40 upon contact with flange 70 when magazine 72 is inserted into magazine well 102. A receiving groove 48 is positioned near the bottom of sleeve 40 for attachment of first end 62 of spring 60.

Figure 4:
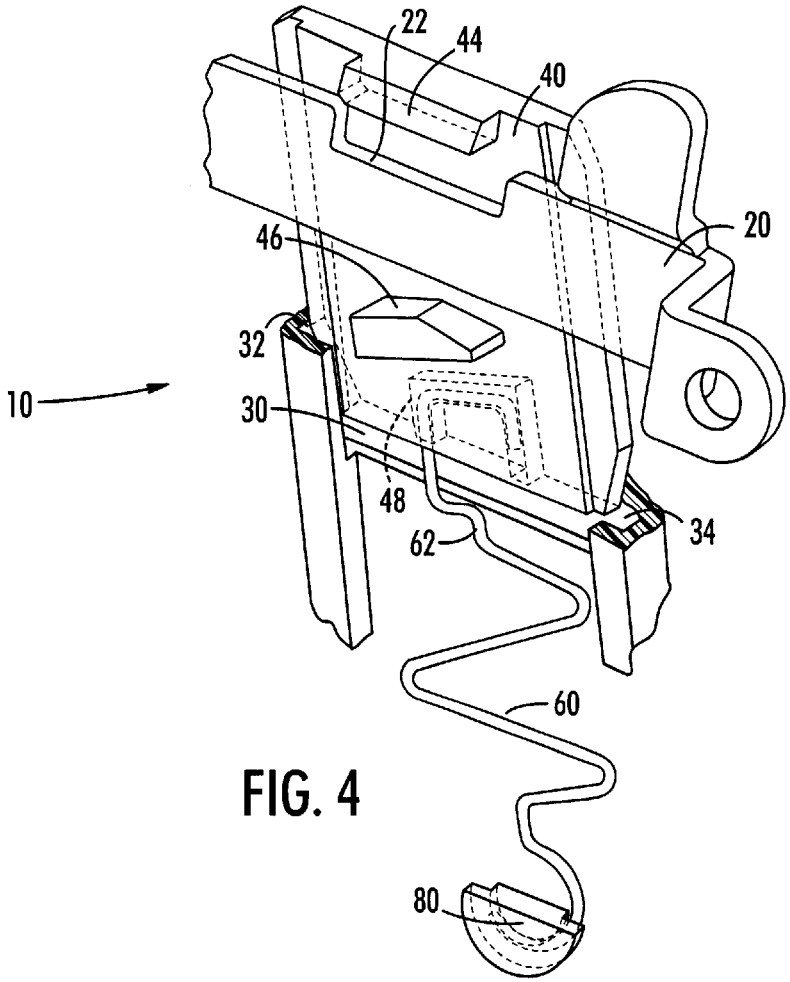
FIG. 4 is a left side perspective view of the magazine safety, with a magazine fully inserted, according to a preferred embodiment of the present invention.

A spring 60 is biased between a pin 80 and receiving groove 48 to urge sleeve 40 downward as best illustrated in FIG. 4. If a magazine 72 is not fully seated within the magazine well 102, downward position of sleeve 40 allows engagement of blocking projection 44 into notch 22 of trigger bar 20. The engagement of flange 70 with engaging projection 46 overcomes bias of spring 60 and lifts sleeve 40 so that blocking projection 44 does not engage notch 22 of trigger bar 20.

In use, with an empty magazine well 102 or with a magazine 72 that is not fully seated, sleeve 40 is urged downward by spring 60 so that blocking projection 44 engages notch 22 to prevent movement of trigger bar 20. In this safe position, trigger bar 20 cannot move laterally and consequently firearm 100 is incapable of firing. Once a magazine 72 is fully inserted into magazine well 102, flange 70 will engage engaging projection 46 so blocking projection 44 will not prevent movement of trigger bar 20. In this firing position, trigger bar 20 is free to move and firearm 100 is capable of firing.

It will be apparent to those skilled in the art that many changes and substitutions can be made to the preferred embodiment herein described without departing from the spirit and scope of the present invention.

What is claimed is:

1. A firearm comprising:

a frame;

a handle attached to said frame having a magazine well formed therein;

a barrel carried by said frame;

a firing mechanism carried by said frame and capable of discharging a bullet through said barrel and from said firearm;

a trigger carried by said frame;

a trigger bar carried by said frame and in operative connection with said trigger and said firing mechanism so that, when said trigger is pulled, said firing mechanism fires, said trigger bar having a notch;

a sleeve carried by said magazine well and slidable between a fire and a safe position, said sleeve having a blocking projection dimensioned to be received in said notch and, when received in said notch, to block movement of said trigger bar, said sleeve having an engagement projection for engaging a magazine as said magazine is inserted into said magazine well, said sleeve being lifted so that said engagement projection clears said notch of said trigger bar as the magazine inserted into said magazine well and engages said engagement projection;

means for urging said sleeve into said safe position; and means responsive to the insertion of a magazine into the firearm for moving said engagement projection from said safe position to said fire position so that movement of said trigger bar is allowed.

2. The firearm as recited in claim 1, wherein said blocking means is received in said notch to block movement of said trigger bar when said sleeve is in said safe position.

3. The firearm as recited in claim 1, wherein said urging means is a spring.

4. The firearm as recited in claim 3, wherein said spring urges said blocking projection of said sleeve into said notch of said trigger arm.

5. The firearm as recited in claim 3, wherein said sleeve has a receiving groove for receiving said spring.

6. The firearm as recited in claim 1, wherein said magazine well has a pocket formed therein, said pocket dimensioned to receive said sleeve.

7. The firearm as recited in claim 6, wherein said urging means urges said sleeve into said pocket.

8. The firearm as recited in claim 7, wherein said pocket limits downward movement of said sleeve.

* * * * *